US005542198A

United States Patent [19]

Famolare

[11] Patent Number: 5,542,198

[45] Date of Patent: Aug. 6, 1996

[54] BOWLING SHOE CONSTRUCTION WITH REMOVABLE SLIDE PAD AND HEEL

[75] Inventor: Leo H. Famolare, Kennebunkport, Me.

[73] Assignee: Dexter Shoe Company, Dexter, Me.

[21] Appl. No.: 360,459

[22] Filed: Dec. 21, 1994

Related U.S. Application Data

[63] Continuation-in-part of Ser. No. 203,906, Feb. 23, 1994.

[51] Int. Cl.[6] ..... A43B 5/00; A43C 13/00

[52] U.S. Cl. ..... 36/130.0; 36/15.0; 36/114.0; 36/36 R

[58] Field of Search ..... 36/130, 25 R, 36/15, 14, 103, 71.5, 114, 36 R, 36 A, 36 B, 36 C

[56] References Cited

U.S. PATENT DOCUMENTS

| | | | |
|---|---|---|---|
| 1,395,958 | 11/1921 | Hamilton . | |
| 2,640,283 | 6/1953 | McCord . | |
| 3,027,661 | 4/1962 | McCord . | |
| 3,041,746 | 7/1962 | Rakus | 36/36 R |
| 3,063,169 | 11/1962 | Cortina | 36/36 R |
| 3,068,592 | 12/1962 | Antelo | 36/36 B |
| 3,195,244 | 7/1965 | Whitcas . | |
| 3,318,025 | 5/1967 | Antelo | 36/36 B |
| 3,478,447 | 11/1969 | Gillead | 36/36 R |
| 3,672,077 | 6/1972 | Coles . | |
| 4,214,384 | 7/1980 | Gonzales | 36/36 R |
| 4,351,120 | 9/1982 | Dalebout . | |
| 4,377,042 | 3/1983 | Bauer . | |
| 4,445,285 | 5/1984 | Phillips . | |
| 4,551,930 | 11/1985 | Graham et al. | 36/30 R |
| 4,716,664 | 1/1988 | Taylor . | |

FOREIGN PATENT DOCUMENTS

| | | | |
|---|---|---|---|
| 0510384 | 10/1992 | European Pat. Off. . | |
| 19561 | 11/1891 | United Kingdom | 36/36 B |
| 23401 | 11/1905 | United Kingdom | 36/36 B |
| 302111 | 12/1928 | United Kingdom . | |

OTHER PUBLICATIONS

"Self Adhering Nylon Tapes" Journal of the AMA vol. 168 No. 7 Oct 18, 1958 Dr. Gershman.

*Primary Examiner*—Paul T. Sewell
*Assistant Examiner*—Marie Denise Patterson
*Attorney, Agent, or Firm*—Fish & Richardson P.C.

[57] ABSTRACT

A bowling shoe construction includes a shoe upper, and a shoe sole mounted to the shoe upper. The shoe sole has a tread surface and a slide area on the tread surface extending longitudinally from a toe end of the shoe sole rearwardly to an arch portion thereof, and extending laterally across the entire width of the tread surface. The bowling shoe construction further includes a removable slide pad having a peripheral margin substantially equal to the peripheral margin of the slide area on the tread surface. The slide pad is removably secured to the tread surface by means of interlocking hook and pile fastener materials attached to the slide area of the tread surface and to the slide pad. The shoe construction still further include a removable heel which is removably secured to the heel portion of the tread surface with hook and pile fastener materials.

3 Claims, 3 Drawing Sheets

BOWLING SHOE CONSTRUCTION WITH REMOVABLE SLIDE PAD AND HEEL

BACKGROUND AND SUMMARY OF THE INVENTION

This is a continuation-in-part of copending application Ser. No. 08/203,906, filed Feb. 23, 1994. The instant invention relates to shoe constructions, and more particularly to a bowling shoe construction having a removable slide pad and heel for varying the friction of the bowling shoe sole on the bowling surface.

Bowling shoes of the general type contemplated herein have heretofore been known in the art. In this regard, the U.S. Pat. Nos. to McCord 2,640,283; McCord 3,027,661; and Coles 3,672,077 represent the closest prior art to the subject invention of which the applicant is aware. In general, each of the patents discloses a bowling shoe having a replaceable tread insert, or inserts, for varying the friction of the shoe sole on the bowling surface. However, each has drawbacks which will be discussed hereinafter. The patent to McCord U.S. Pat. No. 2,640,283 discloses a bowler's shoe having a replaceable tread insert received into a longitudinal recess extending along the bottom of the shoe sole. The tread insert is held in position by front and rear tangs on the insert. The tangs are received into slots provided in the shoe sole. In this connection, it is noted out that the tread insert only covers a center longitudinal portion of the shoe sole. Accordingly, there is a peripheral area of shoe sole material surrounding the insert. This peripheral area of material makes substantial contact with the bowling surface and affects with the bowler's movement across the bowling surface. The patent to McCord U.S. Pat. No. 3,027,661 discloses another bowling shoe sole construction having a replaceable tread insert. A recess is formed in the shoe sole and the insert is held in position by means of hook and pile fasteners attached to the bottom of the recess and the backside of the tread insert. While the hook and pile fasteners are more effective for holding the tread insert in position in the recess, the problem associated with the peripheral shoe sole material is still present. The patent to Coles U.S. Pat. No. 3,672,077 concerns yet another bowling shoe construction, wherein a plurality of spaced recesses are formed in the bottom of the shoe sole, and a plurality of cleats, or inserts, are received into the recesses. The inserts are held in position in the recesses with hook and pile fasteners. The user may selectively replace individual cleats in order to vary the friction of the shoe sole on the bowling surface. While the plurality of cleats covers a greater surface on the shoe sole and offers greater versatility for varying the friction of the shoe sole, the peripheral shoe sole material nevertheless makes contact with the bowling surface and affects with the movement of the bowler across the bowling surface.

The instant invention provides a bowling shoe construction having a removable slide pad that covers the entire slide area of the shoe sole and further provides a removable heel. The instant bowling shoe construction comprises a shoe upper, and a shoe sole mounted to the shoe upper. The shoe sole has a tread surface, and a slide area on the tread surface extending longitudinally from a toe end of the shoe sole rearwardly to an arch portion thereof, and extending laterally across the entire width of the tread surface. The bowling shoe construction further comprises a removable slide pad having a peripheral margin equal to the peripheral margin of the slide area on the tread surface so that the slide pad completely overlays the slide area. The slide pad is removably secured to the tread surface by means of interlocking hook and pile fastener materials attached to the slide area of the tread surface and to the slide pad. In a second embodiment, the shoe construction includes a removable slide pad and a removable heel which are removably secured to the sole of the shoe with hook and pile fastener materials. The removable slide pad and heel enable the bowler to select slide materials having desired frictional characteristics to improve sliding on varying bowling lane surface conditions.

Accordingly, it is an object of the instant invention to provide a bowling shoe construction with a removable slide pad.

It is another object to provide a bowling shoe construction having a removable slide pad that covers the entire slide area of the shoe sole.

It is yet another object to provide a bowling shoe construction having a removable slide pad and heel.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
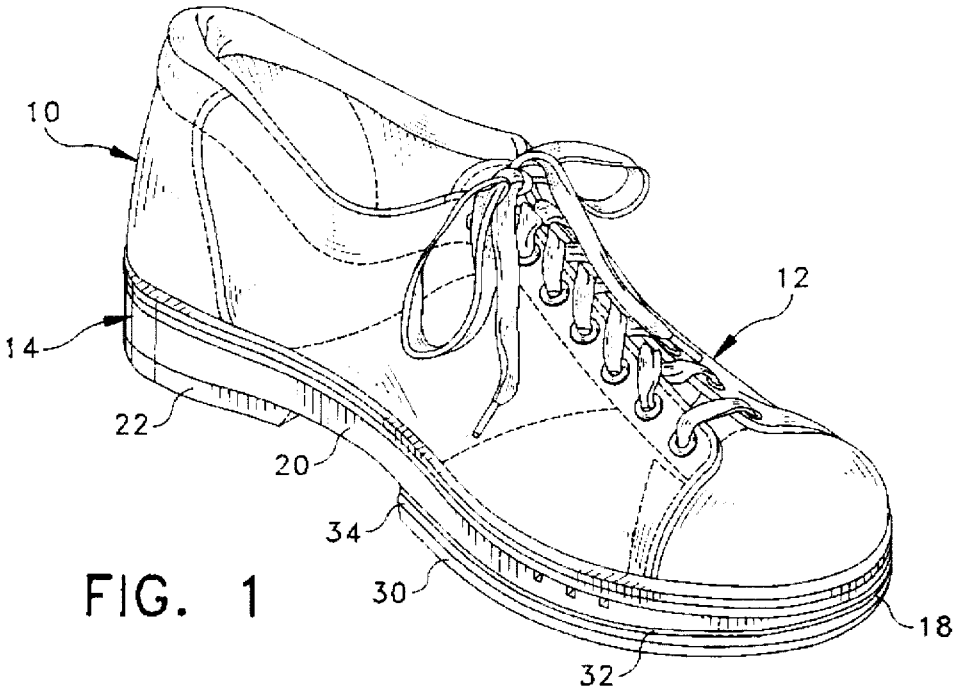
FIG. 1 is a perspective view of a first embodiment of the bowling shoe construction of the instant invention.
Figure 2:
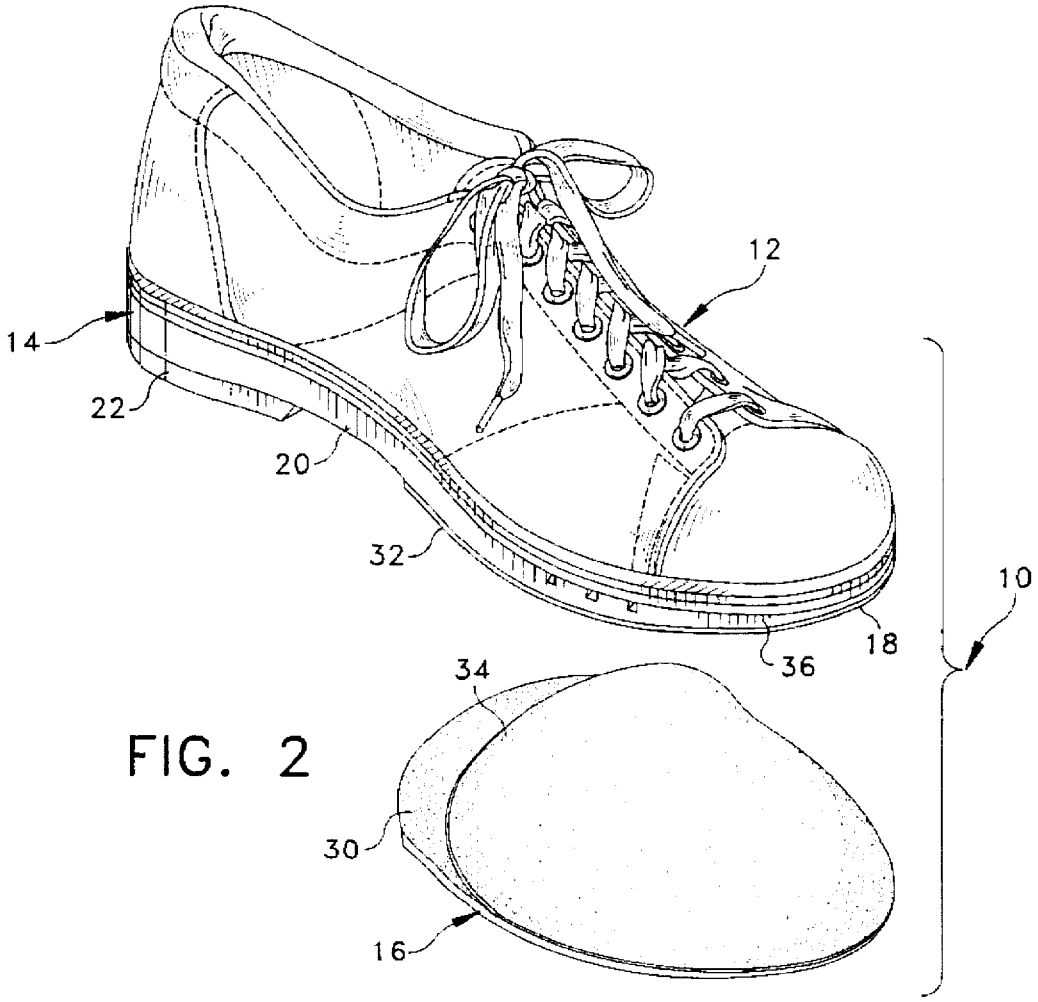
FIG. 2 is an exploded perspective view thereof with the pile fastener material partially peeled away from the slide material for purposes of illustration.
Figure 3:
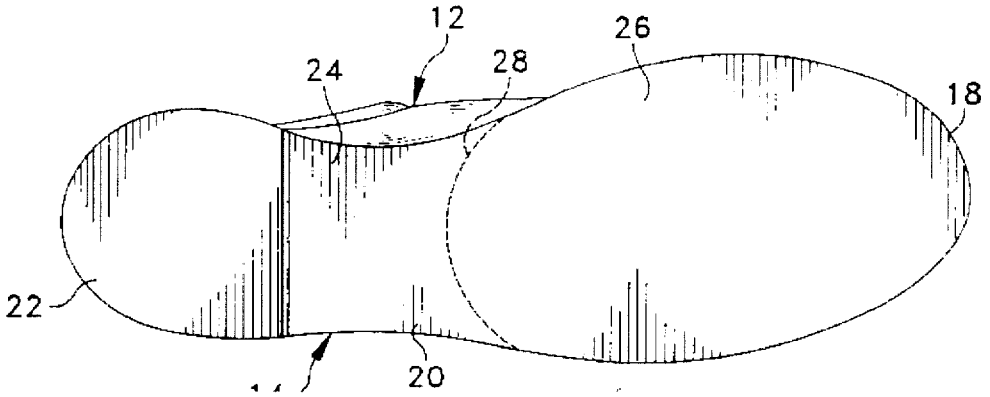
FIG. 3 is a bottom view of the tread surface with the slide area shown in broken lines.
Figure 4:
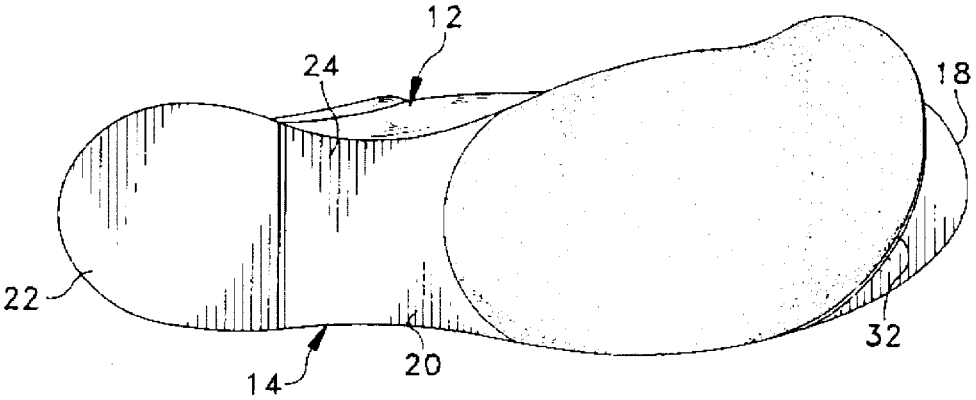
FIG. 4 is another view of the shoe sole with the hook fastener material partially peeled away from the tread surface for purposes of illustration.
Figure 5:
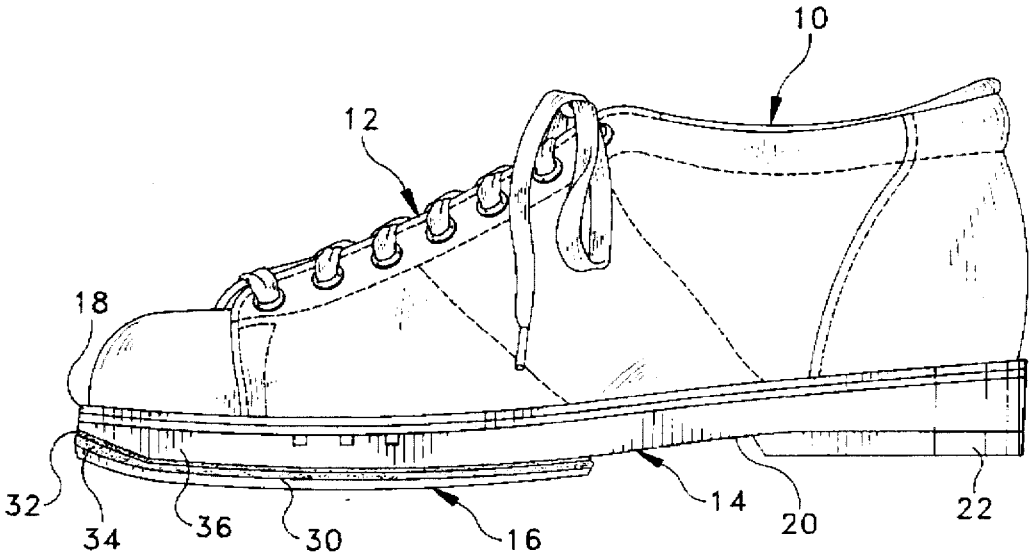
FIG. 5 is a side view thereof.

Referring now to the drawings, a first embodiment of the instant bowling shoe construction is illustrated and generally indicated at 10 in FIGS. 1–5. As will hereinafter be more fully described, the instant bowling shoe construction 10 is intended to include a plurality of interchangeable slide pads for varying the friction of the shoe sole on a bowling surface. The bowling shoe construction 10 comprises a shoe upper generally indicated at 12, a shoe sole generally indicated at 14, and a removable slide pad generally indicated at 16.

The shoe upper 12 is conventional in construction, and it is preferably constructed from leather materials. The shoe sole 14 is preferably constructed from rubber, although other conventional shoe sole materials are also suitable. The shoe sole 14 includes a toe end 18, an arch portion 20, a heel portion 22, and a downwardly facing tread surface 24 (see FIGS. 3 and 4). The tread surface 24 includes a slide area 26 adjacent the toe end 18 of the sole 14. More specifically, the slide area 26 extends longitudinally from the toe end 18 rearwardly to an arch portion (bounded by broken line 28), and laterally across the entire width of the tread surface 24. Accordingly, it can be seen that the slide area 26 covers the entire tread surface 24 adjacent to the toe end 18 of the shoe sole 14.

The slide pad 16 comprises a thick sheet of flexible "slide material" 30 having a predetermined friction characteristic. In this connection, a plurality of different "slide materials", such as leather and the like, which have varied friction characteristics, are well known in the bowling shoe art. The slide pad 16 preferably has a substantially identical peripheral margin as the slide area 26 so that pad 16 covers the entire slide area 26.

The slide pad 16 is removably secured to the slide area 26 of the tread surface 24 by means of hook and pile fastener materials, 32 and 34 respectively, which are attached to the tread surface 24 and the slide material 30. The hook material 32 is preferably attached to the entire slide area 26 of the tread surface 24, and the pile material 34 is preferably attached to the slide material 30. Attachment of the hook and pile materials 32 and 34 to their respective surfaces is accomplished by means of adhesives.

In use, the slide pad 16 is aligned over the slide pad area 26 of the tread surface 24, and the pile material 34 of the slide pad 16 is firmly pressed against the hook material 32 to secure the slide pad 16 in position. To vary the friction characteristics of the bowling shoe 10, the user simply removes one slide pad 16 and replaces it with another slide pad 16 (only one slide pad 16 shown) having a different slide material, thereby giving the bowling shoe 10 different friction characteristics.

The toe end 18 of the shoe sole 14 further includes a wedge area 36 (FIG. 5) which angles upwardly and forwardly from the tread surface 24 toward the shoe upper 12. The wedge area 36 angles the front edge of the slide pad 16 upwardly, away from the bowling surface, and thereby prevents the front edge of the slide pad 16 from accidentally snagging on the floor.

Figure 6:
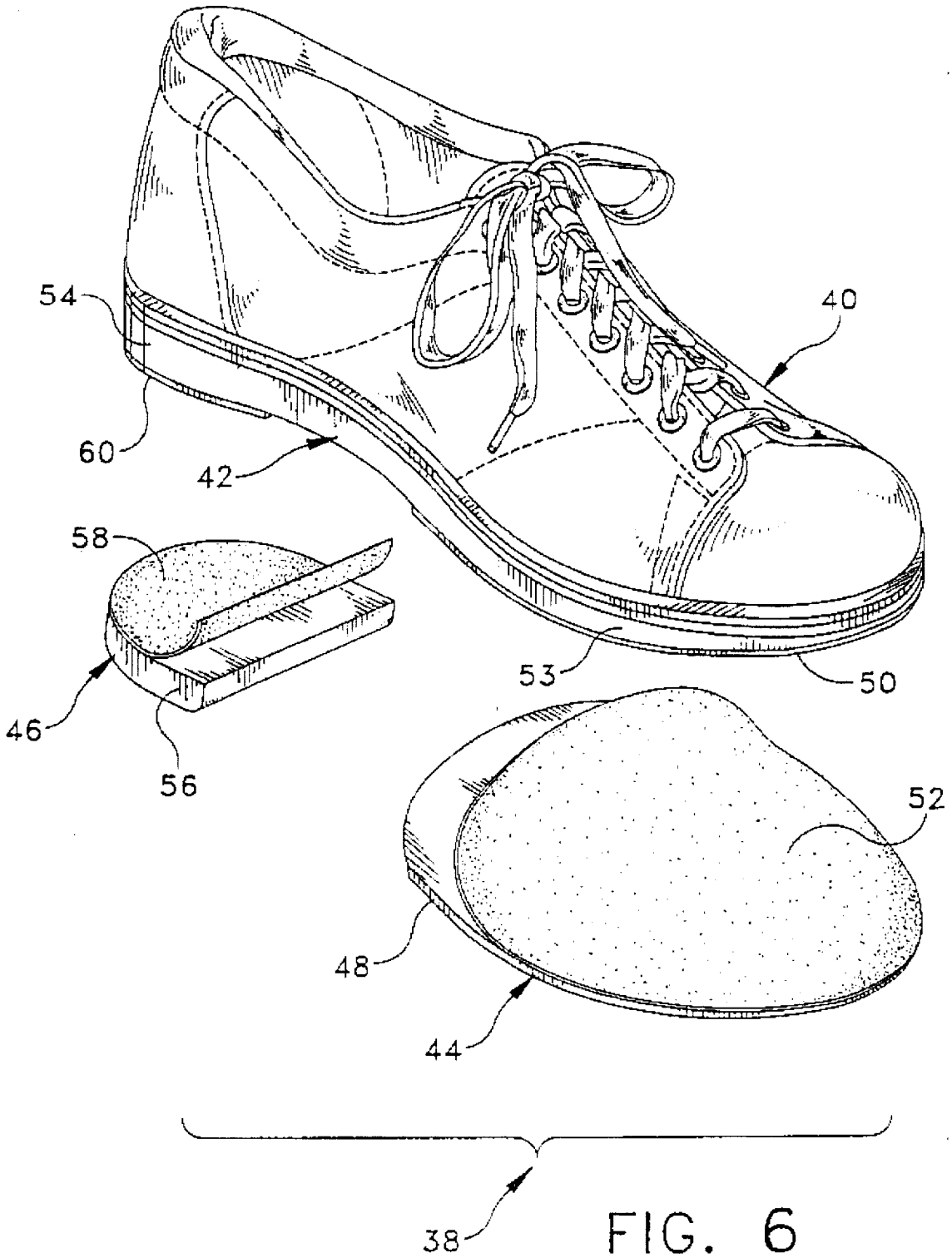
FIG. 6 is a perspective view of a second embodiment thereof with the pile fastener materials of the slide pad and heel partially peeled away from their respective slide materials for purposes of illustration.

Referring now to FIG. 6, a second embodiment of the shoe sole construction is illustrated and generally indicated at 38. Bowling shoe construction 38 comprises a shoe upper generally indicated at 40, a shoe sole generally indicated at 42, a removable slide pad generally indicated at 44, and a removable heel generally indicated at 46. Removable slide pad 44 comprises a slide material 48 as described hereinabove wherein the slide pad 42 extends across the entire slide area of the tread surface. The slide material 48 is removably secured to the tread surface of sole 42 by means of hook and pile fasteners 50,52 respectively, as described hereinabove. The shoe sole 42 also includes an upwardly angled wedge area 53 adjacent the toe portion substantially as described hereinabove. The shoe sole 42 further includes a heel portion 54. As shown in FIG. 6, the removable heel 46 comprises a thick, yet flexible, "slide material" 56 having a predetermined friction characteristic. In this connection, a plurality of different "slide materials", such as rubber and the like, which have varied friction characteristics, are well known in the bowling shoe art. The removable heel 46 is removably secured to the heel portion 54 of sole 42 by means of hook and pile fastener materials 58,60 respectively. Attachment of the hook and pile fastener materials 58,60 to their respective surfaces is preferably accomplished by means of conventional adhesives.

The combination of the removable slide pad and the removable heel provides bowlers with the flexibility to completely rebuild one pair of shoes to satisfy their needs in virtually all lane surface conditions. Heretofore, a bowler would need to carry as many as 6 pairs of shoes to satisfy various conditions. A further benefit to the removable heel is that the heel height can be raised or lowered instantly to the bowlers preference.

It can therefore be seen that instant invention provides two unique bowling shoe constructions which overcome the disadvantages of the prior art bowling shoes. By covering the entire slide area 26 of the tread surface 24, there are no peripheral edge portions of the tread surface 24 which make contact with the bowling surface. The instant slide pad construction thus allows the shoe 10 to function as though the entire sole was constructed from the selected slide material. The wedge 36 at the toe end 18 of the sole 14 angles the front edge of the slide pad 16 upwardly away from the bowling surface and prevents the slide pad 16 from snagging on the bowling surface and accidentally becoming separated from the tread surface 24. Accordingly, it can be seen that the instant bowling shoe constructions provide the benefits of interchangeable slide pads while also providing the benefits of having the slide pad 16 cover the entire slide area 26 of the tread surface 24. Furthermore, the removable heel 46 enables the bowler to further modify the frictional characteristics of the shoe, thereby making the shoe construction even more versatile. For these reasons, the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A bowling shoe kit comprising:

a shoe upper;

a shoe sole mounted to the shoe upper, said shoe sole having a tread surface and a slide area on said tread surface extending longitudinally from a toe end of said shoe sole rearwardly to an arch portion thereof and extending laterally across an entire width of said tread surface, said shoe sole further including a wedge which angles upwardly and forwardly from said tread surface toward said shoe upper;

a plurality of slide pads each having a peripheral margin substantially equal to a peripheral margin of said slide area of said tread surface, each of said plurality of slide pads being fabricated from a material having a different coefficient of friction;

means for removably securing a selected slide pad to said slide area of said tread surface wherein said selected slide pad substantially covers said slide area, and whereby said plurality of slide pads are readily interchangeable to vary the coefficient of friction of the slide area of the tread surface according to bowling lane conditions;

a plurality of heels, each being fabricated from a material having a different coefficient of friction; and means for removably securing a selected heel to a heel portion of said tread surface of said shoe sole, whereby said plurality of heels are readily interchangeable to vary the coefficient of friction of the heel portion of the tread surface according to bowling lane conditions, said interchangeable slide pads and said interchangeable heels cooperating to provide a tread surface having a variable coefficient of friction between the slide area and the heel portion.

2. In the bowling shoe kit of claim 1, said means for removably securing said selected slide pad comprising hook and pile fastener materials attached to said selected slide area of said tread surface and said slide pad.

3. In the bowling shoe kit of claim 2, said means for removably securing said selected heel comprising hook and pile fastener materials attached to said heel portion of said tread surface and said selected heel.

* * * * *

UNITED STATES PATENT AND TRADEMARK OFFICE

CERTIFICATE OF CORRECTION

PATENT NO. : 5,542,198

DATED : August 6, 1996

INVENTOR(S) : Leo H. Famolare

It is certified that error appears in the above-identified patent and that said Letters Patent is hereby corrected as shown below:

Col. 4, line 60, please delete "selected".

Col. 4, line 61, before "slide pad" insert --selected--.

Signed and Sealed this

Sixth Day of January, 1998

Bruce Lehman

*Attest:*

BRUCE LEHMAN

*Attesting Officer*

*Commissioner of Patents and Trademarks*